US010823351B2

(12) United States Patent
Fan et al.

(10) Patent No.: US 10,823,351 B2
(45) Date of Patent: Nov. 3, 2020

(54) ELECTRONIC CANDLE LAMP

(71) Applicant: SHENZHEN TONGFANG OPTOELECTRONIC TECHNOLOGY CO., LTD, Shenzhen (CN)

(72) Inventors: Baosheng Fan, Shenzhen (CN); Huaming Cui, Shenzhen (CN)

(73) Assignee: SHENZHEN TONGFANG OPTOELECTRONIC TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 16/712,999

(22) Filed: Dec. 13, 2019

(65) Prior Publication Data

US 2020/0191348 A1 Jun. 18, 2020

(30) Foreign Application Priority Data

Dec. 14, 2018 (CN) ..... 2018 1 1532027

(51) Int. Cl.
*F21S 10/04* (2006.01)
*F21K 9/238* (2016.01)
(Continued)

(52) U.S. Cl.
CPC ..... *F21S 10/04* (2013.01); *F21K 9/238* (2016.08); *F21S 6/001* (2013.01); *F21S 9/02* (2013.01); *F21Y 2115/10* (2016.08)

(58) Field of Classification Search
CPC ..... F21S 10/04; F21S 6/001; F21S 10/046
See application file for complete search history.

(56) References Cited

U.S. PATENT DOCUMENTS

2015/0036348 A1* 2/2015 Dong ..... F21V 14/08 362/293
2015/0233538 A1* 8/2015 Sheng ..... F21S 10/046 362/190
(Continued)

FOREIGN PATENT DOCUMENTS

CN 203642062 U 6/2014
CN 105757602 A 7/2016
(Continued)

OTHER PUBLICATIONS

Extended European Search Report dated Apr. 3, 2020, issued on European Patent Application No. 19216167.7 in the name of Shenzen Tongfang Optoelectronics Technology Co. Ltd.

*Primary Examiner* — Eric T Eide
(74) *Attorney, Agent, or Firm* — Franklin & Associates International Inc; Matthew Lambrinos

(57) ABSTRACT

An electronic candle lamp includes a housing, a flat plate, a fixing cylinder, a flame-like sheet, a connecting sheet, a pendulum, a magnet, an electromagnetic coil, a control circuit board, a spring, a first supporting rod, a second supporting rod, a bracket, a light emitting diode (LED) lamp, a convex mirror, and a battery pack. A through hole is defined at a connection of the flame-like sheet and the connecting sheet through which the second supporting rod passes. The flame-like sheet is suspended on the second supporting rod via the through hole. The battery pack is electrically connected to the control circuit board. The control circuit board is electrically connected to the electromagnetic coil and the LED lamp, respectively.

12 Claims, 8 Drawing Sheets

(51) Int. Cl.

| | |
|---|---|
| ***F21S 6/00*** | (2006.01) |
| ***F21S 9/02*** | (2006.01) |
| ***F21Y 115/10*** | (2016.01) |

(56) References Cited

U.S. PATENT DOCUMENTS

| | | | | |
|---|---|---|---|---|
| 2016/0109083 | A1* | 4/2016 | Li | F21S 10/04 362/84 |
| 2017/0038020 | A1* | 2/2017 | Patton | F21V 15/01 |
| 2017/0167677 | A1 | 6/2017 | Patton | |
| 2018/0010750 | A1* | 1/2018 | Cheng | F21V 14/02 |
| 2019/0063703 | A1* | 2/2019 | Hurduc | F21S 10/046 |
| 2019/0195447 | A1* | 6/2019 | Wu | B05B 1/14 |

FOREIGN PATENT DOCUMENTS

| | | | |
|---|---|---|---|
| CN | 106090819 | A | 11/2016 |
| CN | 206280886 | U | 6/2017 |
| CN | 207599585 | U | 7/2018 |
| WO | 2016000517 | | 1/2016 |

* cited by examiner

ELECTRONIC CANDLE LAMP

CROSS-REFERENCE TO RELATED APPLICATION

This application claims the benefit of Chinese Patent Application No. 201811532027.X, filed on Dec. 14, 2018, the entire content of which is incorporated herein in its entirety.

TECHNICAL FIELD

The present disclosure relates to the field of illumination, in particular to an electronic candle lamp.

BACKGROUND

At present, the flame-like sheet of the conventional electronic candle lamp is suspended on the bracket for swinging, where the swing amplitude of the flame-like sheet of the structure is small and the swing is not smooth, thereby resulting in poor effect of simulating the flame swing during burning of the candle.

SUMMARY

According to various embodiments of the present disclosure, electronic candle lamps are provided.

The electronic candle lamp according to one embodiment of the present disclosure may include a housing, forming a mounting hole at a top thereof and an opening at a bottom thereof; a fixing cylinder, vertically placed at the mounting hole of the housing and located inside the housing, wherein an opening is formed at a top of the fixing cylinder; a control circuit board, provided at a bottom of the fixing cylinder and configured to adjust lighting effect and control a corresponding operation; a flame-like sheet assembly, provided at the opening of the top of the fixing cylinder, wherein the flame-like sheet assembly protrudes from the mounting hole of the housing through the opening of the top of the fixing cylinder; an elastic supporting assembly, provided inside the fixing cylinder and located at an upper part thereof, wherein the elastic supporting assembly movably extends through the flame-like sheet assembly; a light emitting diode (LED) lamp, provided on the control circuit board and electrically connected to the control circuit board; a light guiding assembly, provided on the control circuit board and configured to guide light emitted by the LED lamp to the flame-like sheet assembly to illuminate the flame-like sheet assembly; and a power source, provided at the opening of the bottom of the housing and electrically connected to the control circuit board.

The details of one or more embodiments of the disclosure are set forth in the accompanying drawings and the description below. Other features, objects, and advantages of the disclosure will be apparent from the description and drawings, and from the claims.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

DETAILED DESCRIPTION OF THE EMBODIMENTS

In order to facilitate understanding of the disclosure, the disclosure will be described more fully below with reference to the accompanying drawings. Preferred embodiments of the present disclosure are shown in the accompanying drawings. However, the present disclosure can be implemented in many different forms and is not limited to the embodiments described herein. On the contrary, it is an object of these embodiments to provide a more thorough understanding of the disclosure of the present disclosure.

It should be noted that when an element is referred to as being "fixed" to another element, it can be directly on the other element or it can also be presence of a central element. When an element is considered to be "connected" to another element, the element can be directly connected to the other element or it can be simultaneous presence of the central element. The terms "vertical", "horizontal", "left", "right" and the like used herein are for illustrative purposes only and are not meant to be the only embodiment.

Figure 1:
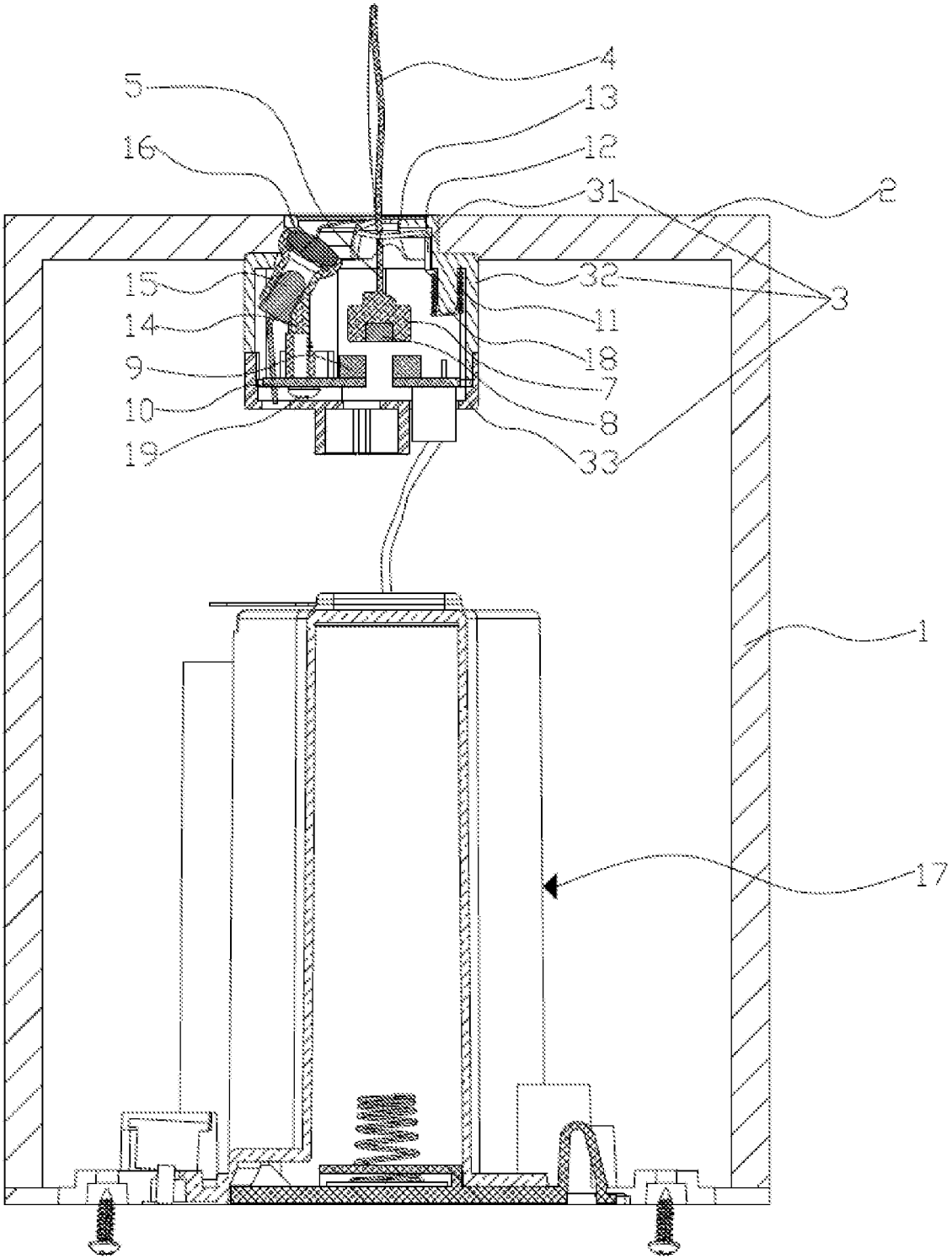
FIG. 1 is a cross-sectional view of a flame-like sheet suspended electronic candle lamp according to an embodiment of the present disclosure.
Figure 2:
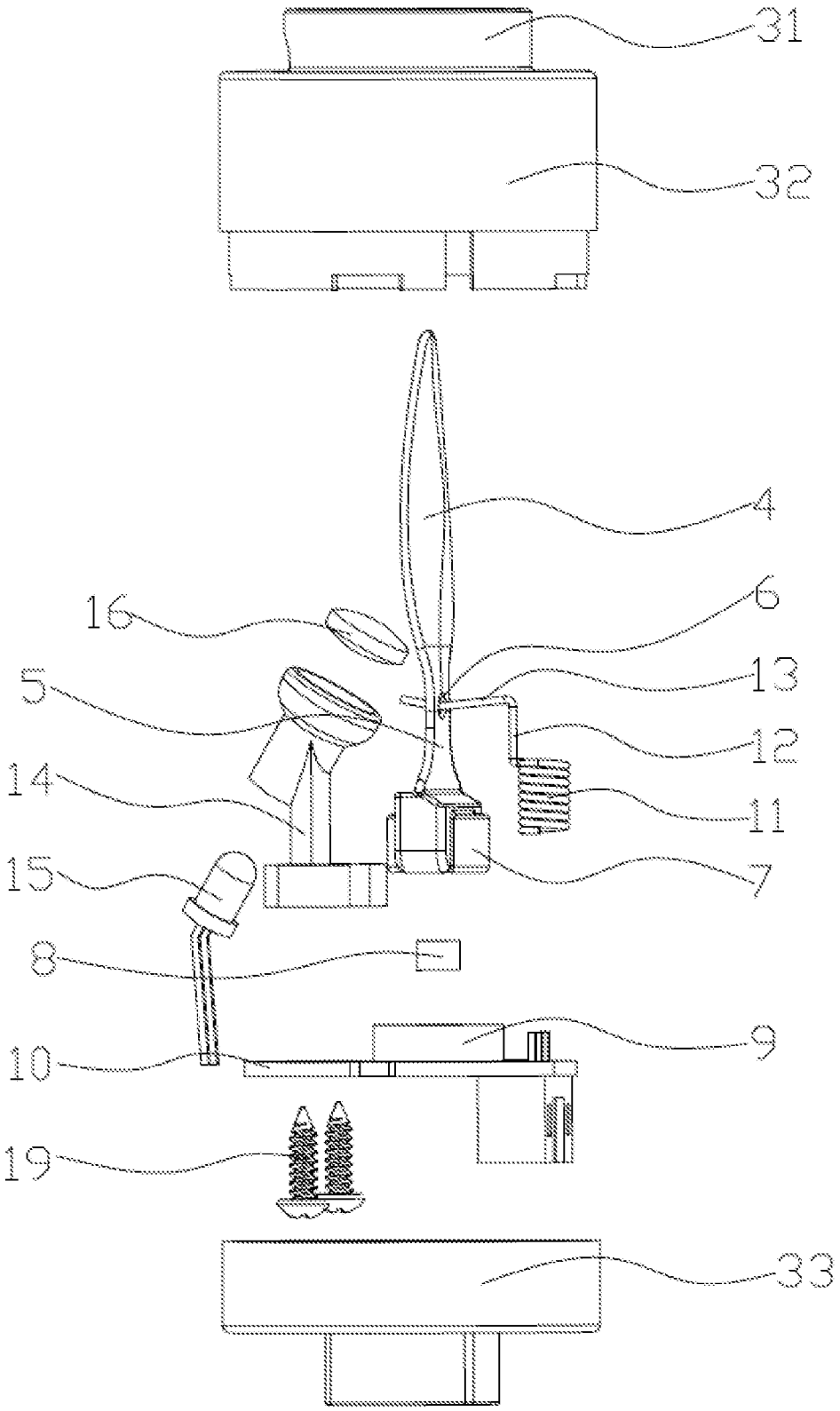
FIG. 2 is an exploded schematic view of an internal structure of a fixing cylinder in FIG. 1.
Figure 3:
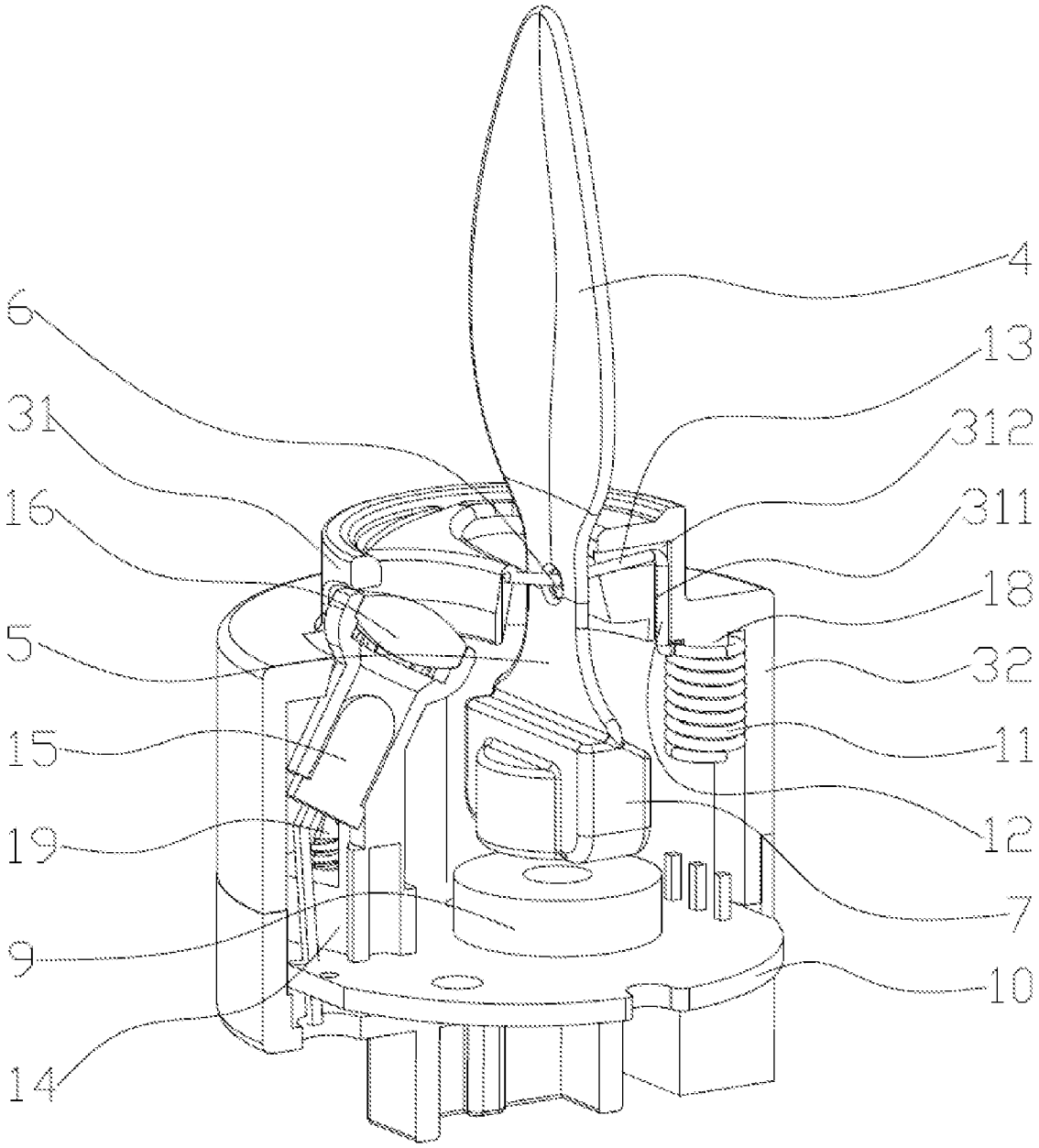
FIG. 3 is a schematic view of the internal structure of the fixing cylinder in FIG. 1.
Figure 4:
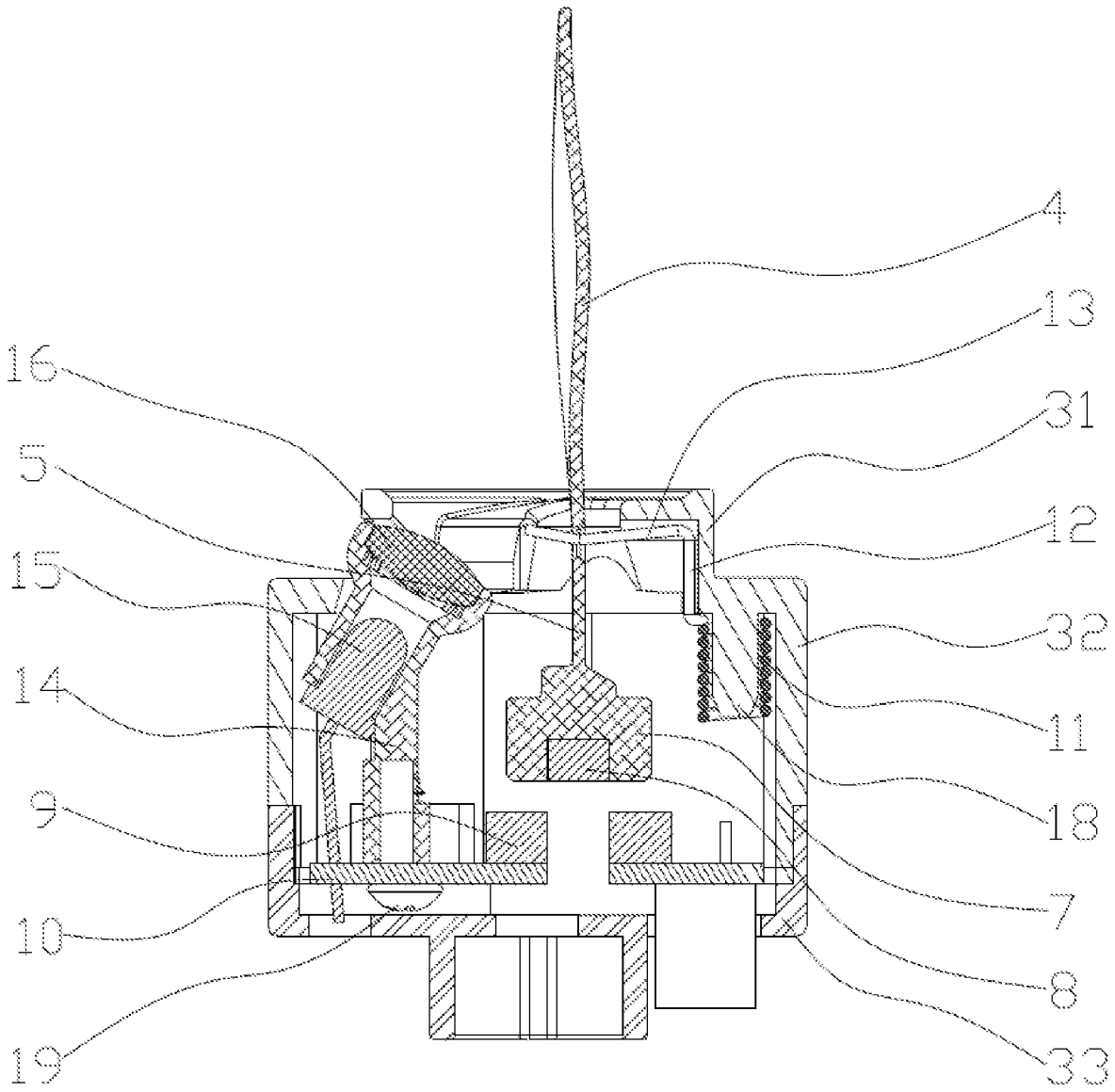
FIG. 4 is a cross-sectional view of the internal structure of the fixing cylinder in FIG. 1.
Figure 8:
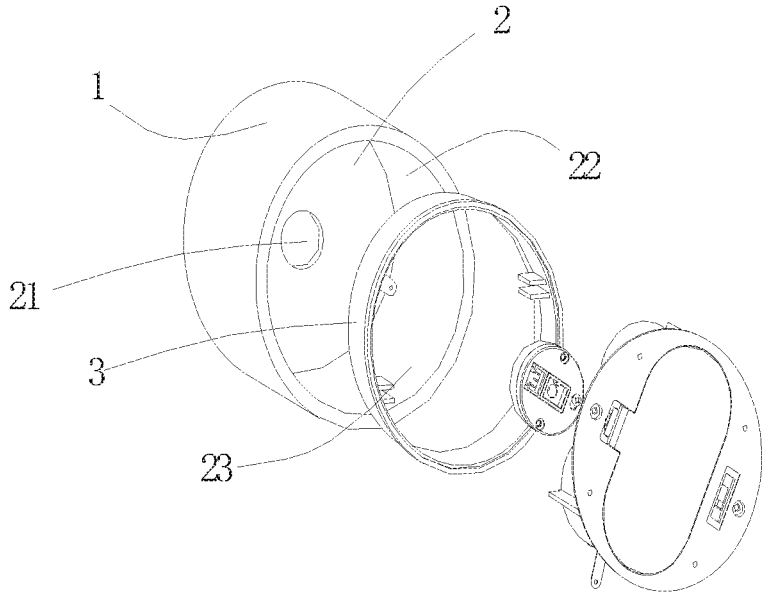
FIG. 8 is an exploded schematic view of a flame-like sheet suspended electronic candle lamp according to an embodiment of the present disclosure.

As shown in FIGS. 1 to 4, a flame-like sheet suspended electronic candle lamp according to an embodiment of the present disclosure includes a vertically provided housing 1. As shown in FIG. 8, The housing 1 in this embodiment may be in a cylinder shape, and the shape may be adjusted according to practical needs, such as in a cubic shape. A flat plate 2 is integrally formed at a top of the housing 1, and an opening 22 is provided at a bottom of the housing 1. A mounting hole 21 is provided with the flat plate 2. The mounting hole 21 is fixedly provided with a fixing cylinder 3 vertically provided in the housing 1. An opening 23 is provided at the top of the fixing cylinder 3. As shown in FIG. 1, in an embodiment, the bottom of the fixing cylinder 3 may be sealed. As shown FIG. 8, in another embodiment, the bottom of the fixing cylinder 3 may be open. The electronic candle lamp further includes a flame-like sheet 4 vertically provided at an opening of the top of the fixing cylinder 3. A vertically provided connecting sheet 5 is fixedly provided at a bottom of the flame-like sheet 4 (in other embodiments, a connecting sheet 5 may be formed in a rod shape). A laterally provided through hole 6 is defined at a connection of the flame-like sheet 4 and the connecting sheet 5. A pendulum 7 is fixed at a bottom of the connecting sheet 5. A magnet 8 is fixed at a bottom of the pendulum 7, and the magnet 8 is opposed to and spaced apart from an electromagnetic coil 9. The electromagnetic coil 9 is fixed on a control circuit board 10. In an embodiment, the control circuit board 10 is configured to adjust lighting effect and control a corresponding operation. For example, the lighting effect may include the brightness of the LED lamp, the swing amplitude of the flame-like sheet and the like. In an embodiment, the flame-like sheet 4, the connecting sheet 5, the pendulum 7, the magnet 8 and the electromagnetic coil 9 constitute a flame-like sheet assembly. In an embodiment, in order to maximally generate quality feel of the electronic candle lamp and enhance the visual experience of the user, the housing 1 can be made of paraffin material or imitating paraffin plastic.

A vertically provided spring 11 is fixedly provided in the upper part of the fixing cylinder 3. A top end of the spring 11 is fixedly connected to a vertically provided first supporting rod 12. A top end of the first supporting rod 12 is fixedly connected to a laterally provided second supporting rod 13. The spring 11, the first supporting rod 12 and the second supporting rod 13 are integrally formed by spring steel (for example, 65Mn, 60Si2Mn, 50CrVA or 55Si2Mn). The second supporting rod 13 passes via the through hole 6. The flame-like sheet 4 is thus suspended on the second supporting rod 13 via the through hole 6. In an embodiment, the spring 11, the first supporting rod 12 and the second supporting rod 13 constitute an elastic supporting assembly. In an embodiment, the spring 11 is configured to save and release energy, which enables more naturally swinging.

Figure 6:
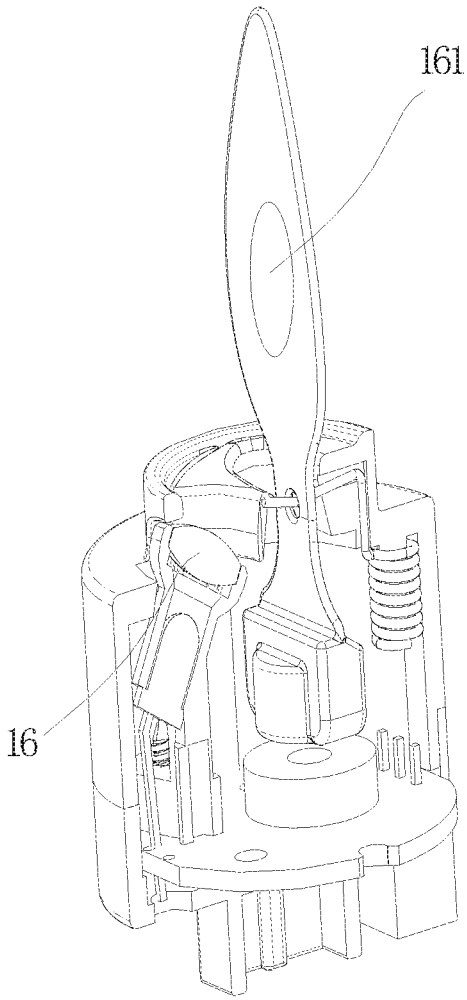
FIG. 6 is a schematic view of the shape of the projected light spot generated by light transmitted through the convex mirror according to an embodiment of the present disclosure.
Figure 7:
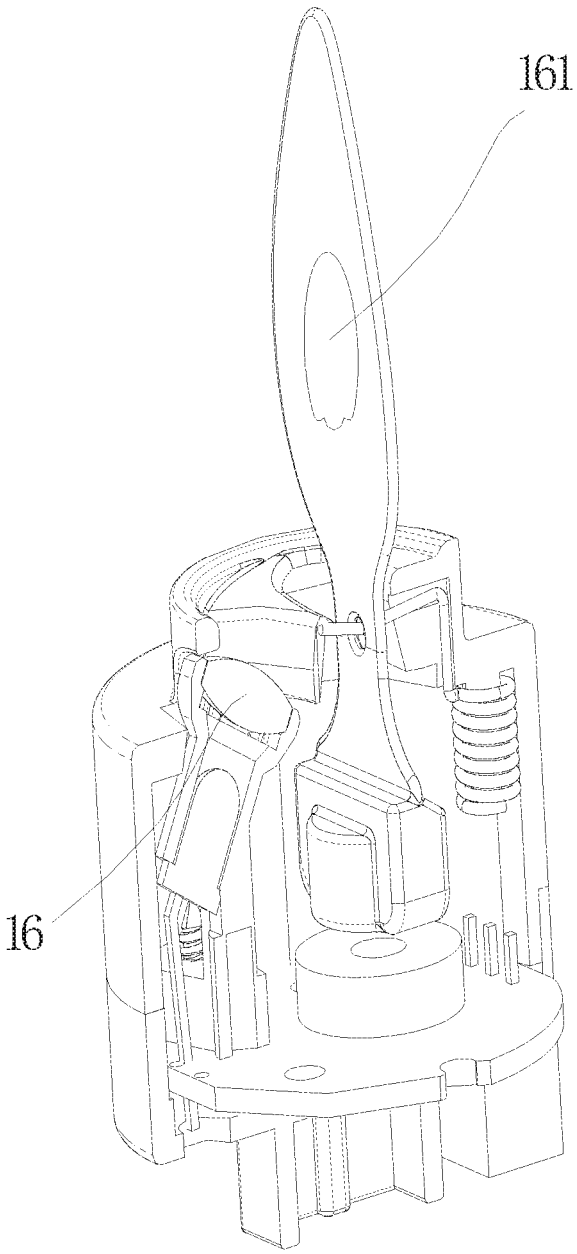
FIG. 7 is a schematic view of the shape of the projected light spot generated by light transmitted through the convex mirror according to another embodiment of the present disclosure.

In an embodiment, the flame-like sheet assembly is illustrated by a light emitting assembly. In an embodiment, the light emitting assembly may include a light source and a light guiding assembly. The light source may include a light emitting diode (LED) lamp and the like. The light guiding assembly may include a convex mirror and the like. The control circuit board 10 is fixed to a bottom of the fixing cylinder 3, and a bracket 14 is also fixed on the control circuit board 10. An upper part of the bracket 14 is provided with a light emitting diode (LED) lamp 15 inclined toward the flame-like sheet 4 and a convex mirror 16 inclined toward the flame-like sheet 4. The convex mirror 16 is located above the LED lamp 15. Light emitted from the LED lamp 15 illuminates the flame-like sheet 4 through the convex mirror 16. In an embodiment, the convex mirror 16 may be of ellipse shape, irregular shape or the like. As shown in FIG. 6, in an embodiment, when the convex mirror 16 is of ellipse shape, the shape of the projected light spot 161 generated by light transmitted through the convex mirror 16 is of ellipse shape. As shown in FIG. 7, in an embodiment, when the convex mirror 16 is of irregular shape, the shape of the projected light spot 161 generated by light transmitted through the convex mirror 16 is of irregular shape. In an embodiment, the irregular shape may be of inner flame-like shape.

A battery pack 17 is fixed at the bottom opening of the housing 1. The battery pack 17 is electrically connected to the control circuit board 10. The control circuit board 10 is electrically connected to the electromagnetic coil 9 and the LED lamp 15, respectively.

In particular, the fixing cylinder 3 includes a first cylinder 31 vertically provided and opened at both ends, a second cylinder 32 vertically provided and opened at both ends, and a base 33, which are fixedly and sequentially connected from top to bottom. The first cylinder 31 and the second cylinder 32 are coaxially provided, and a diameter of the second cylinder 32 is larger than a diameter of the first cylinder 31. The first cylinder 31 is fixed in the mounting hole, and the control circuit board 10 is fixed on the base 33. In an embodiment, the first cylinder 31 and the second cylinder 32 constitute a cylinder assembly.

Figure 5:
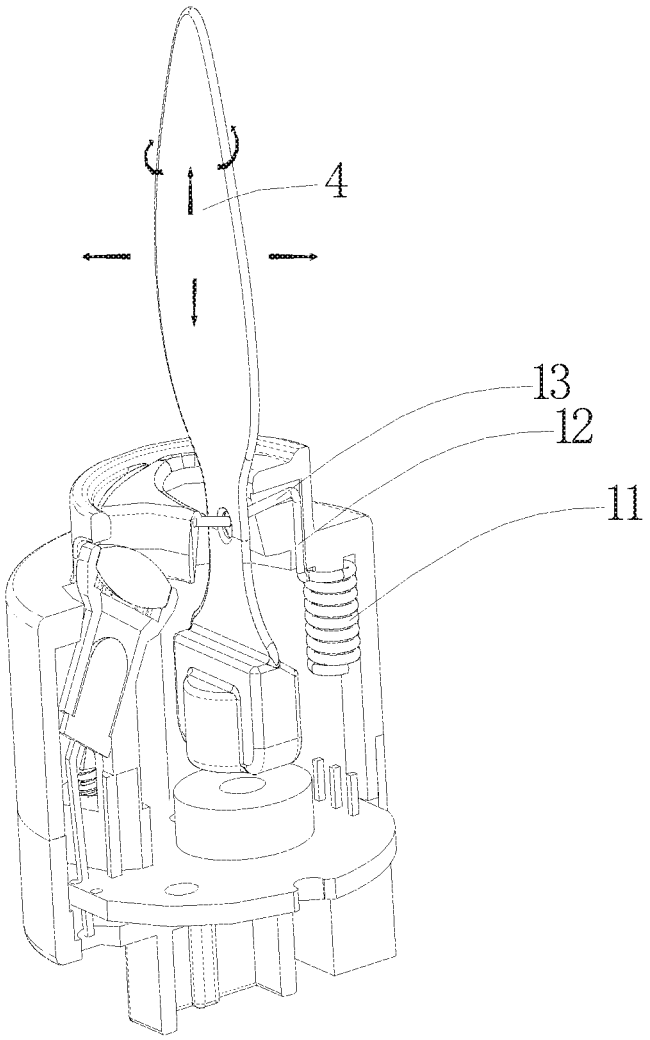
FIG. 5 is a schematic view of the swinging direction of the flame-like sheet according to an embodiment of the present disclosure.

The flame-like sheet 4 is provided at an opening of a top of the first cylinder 31, and a vertically provided first blind hole 311 and a laterally provided second blind hole 312 are defined on an inner wall of one side of the first cylinder 31. An opening of the first blind hole 311 faces the control circuit board 10. An opening of the second blind hole 312 faces the flame-like sheet 4. The first blind hole 311 communicates the second blind hole 312. The first supporting rod 12 is inserted into the first blind hole 311, and the second supporting rod 13 is inserted into the second blind hole 312. The first blind hole 311 is used for limiting the first supporting rod 12, and the second blind hole 312 is used for limiting the second supporting rod 13. Accordingly, movement of the first supporting rod 12 and the second supporting rod 13 caused by swing of the flame-like sheet 4 when the flame-like sheet 4 swings on the second supporting rod 13 can be avoided, thereby ensuring the swing of the flame-like sheet 4 at an original position. In an embodiment, as shown in FIG. 5, the flame-like sheet 4 can keep moving back and forth, left and right, or up and down as indicated by arrows in FIG. 5 through releasing of energy by the spring 11.

A vertically provided mounting pillar 18 is fixedly provided on an inner surface of a top of the second cylinder 32. The spring 11 is sleeved on an outer circumference of the mounting pillar 18. A bottom end of the spring 11 is fixedly connected to a bottom end of the mounting pillar 18.

By example, the bracket 14 is fixedly connected to the control circuit board 10 by a plurality of screws 19.

By example, the bottom end of the spring 11 is fixedly connected to the bottom end of the mounting pillar 18 by thermal compression or bonding.

By example, a middle portion of the second supporting rod 13 is sunken downward, and the flame-like sheet 4 is provided at the sunken portion of the second supporting rod 13, thereby preventing the flame-like sheet 4 from falling off the second supporting rod 13.

The working principle of the flame-like sheet suspended electronic candle lamp according to the present disclosure would be explained below. The control circuit board 10 controls the battery pack 17 to provide a stable direct current to the LED lamp 15, which is in a normally-on state. The light emitted from the LED lamp 15 illuminates the flame-like sheet 4 through the convex mirror 16. When the control circuit board 10 controls the battery pack 17 to supply a direct current to the electromagnetic coil 9, the electromagnetic coil 9 is energized to generate a magnetic field whose magnetic force repels the magnet 8 and has the magnet 8 move away from the electromagnetic coil 9. When the magnet 8 moves away from the electromagnetic coil 9, the spring 11, the first supporting rod 12, and the second supporting rod 13 are elastically deformed, and the spring 11, the first supporting rod 12, and the second supporting rod 13 store elastic potential energy. When the control circuit board 10 controls the battery pack 17 not to supply the direct current to the electromagnetic coil 9, the magnetic field generated by the electromagnetic coil 9 disappears, the magnet 8 moves toward the electromagnetic coil 9 by its own gravity, and at the same time, the spring 11, the first supporting rod 12, and the second supporting rod 13 gradually return to original state and release the elastic potential energy. The elastic potential energy released by the spring 11, the first supporting rod 12, and the second supporting rod 13 can accelerate movement of the magnet 8 toward the electromagnetic coil 9. The electromagnetic coil 9 is thus cyclically energized and de-energized, such that the magnet 8 swings back and forth, and the flame-like sheet 4, the connecting sheet 5, and the pendulum 7 swing back and forth together with the magnet 8.

The technical effects of the flame-like sheet suspended electronic candle lamp according to the present disclosure are as follows:

The spring 11, the first supporting rod 12 and the second supporting rod 13 of the present disclosure are integrally formed to alternately store the elastic potential energy and release the elastic potential energy during swing together with the flame-like sheet 4, the connecting sheet 5, the pendulum 7, and the magnet 8. When the spring 11, the first supporting rod 12, and the second supporting rod 13 release the elastic potential energy, the swing amplitude of the flame-like sheet 4, the connecting sheet 5, the pendulum 7, and the magnet 8 can increase. When the spring 11, the first supporting rod 12, and the second supporting rod 13 which are provided herein release the elastic potential energy, the flame-like sheet 4, the connecting sheet 5, the pendulum 7 and the magnet 8 can swing together more smoothly, thereby making the simulation effect of flame-like sheet 4 swinging back and forth in candle burning more realistic.

The pendulum 7 according to the present disclosure is hung on the spring 11, the first supporting rod 12 and the second supporting rod 13 by the connecting sheet 5, such that the center of gravity of the structure composed of the flame-like sheet 4, the connecting rod 5, the pendulum 7, and the magnet 8 is located on the pendulum 7, thereby making the swing of the flame-like sheet 4, the connecting sheet 5, the pendulum 7, and the magnet 8 more stable.

The flame-like sheet 4, the connecting sheet 5, and the pendulum 7 of the present disclosure are mounted on one side (the left side in the present embodiment) of the spring 11 by the first supporting rod 12 and the second supporting rod 13, thereby significantly saving longitudinal mounting space of the fixing cylinder 3. Accordingly, the longitudinal dimension of the fixing cylinder 3 can be shorter and the volume of the fixing cylinder 3 can be smaller.

According to an aspect of the present disclosure, a flame-like sheet suspended electronic candle lamp is provided. The flame-like sheet suspended electronic candle lamp includes a vertically arranged housing. A flat plate is integrally formed at a top of the housing and an opening is arranged at a bottom of the housing. A mounting hole is defined on the flat plate. The mounting hole is fixedly arranged with a fixing cylinder vertically arranged in the housing. A top of the fixing cylinder is open and a bottom is sealed. The electronic candle lamp further includes a flame-like sheet vertically arranged at an opening of the top of the fixing cylinder. A vertically arranged connecting sheet is fixedly arranged at a bottom of the flame-like sheet. A laterally arranged through hole is defined at a connection of the flame-like sheet and the connecting sheet. A pendulum is fixed at a bottom of the connecting sheet. A magnet is fixed at a bottom of the pendulum, and the magnet is opposed to and spaced apart from an electromagnetic coil. The electromagnetic coil is fixed on a control circuit board.

By example, a vertically provided spring is fixedly provided in the upper part of the fixing cylinder. A top end of the spring is fixedly connected to a vertically provided first supporting rod. A top end of the first supporting rod is fixedly connected to a laterally provided second supporting rod. The spring, the first supporting rod and the second supporting rod are integrally formed. The second supporting rod passes via the through hole. The flame-like sheet is suspended on the second supporting rod via the through hole.

By example, the control circuit board is fixed to a bottom of the fixing cylinder, and a bracket is also fixed on the control circuit board. An upper part of the bracket is provided with a light emitting diode (LED) lamp inclined toward the flame-like sheet and a convex mirror inclined toward the flame-like sheet. The convex mirror is located above the LED lamp. Light emitted from the LED lamp illuminates the flame-like sheet through the convex mirror.

By example, a battery pack is fixed at the bottom opening of the housing. The battery pack is electrically connected to the control circuit board. The control circuit board is electrically connected to the electromagnetic coil and the LED lamp, respectively.

The various technical features of the above-described embodiments can be arbitrarily combined. For the sake of brevity of description, all possible combinations of the respective technical features in the above-described embodiments have not been described, however, as long as there is no contradiction in the combination of these technical features, it should be deemed to be the scope of the specification.

The above-described embodiments represent only several embodiments of the disclosure. The description of the embodiments is more specific and detailed, but are not therefore to be construed as limiting the scope of the disclosure patent. It should be noted that several modifications and improvements can be made to those of ordinary skill in the art without departing from the inventive concept, all of the modifications and improvements fall within the scope of the disclosure. Therefore, the scope of protection of the disclosure patent shall be subject to the appended claims.

What is claimed is:

1. An electronic candle lamp comprising: a housing, forming a mounting hole at a top thereof and an opening at a bottom thereof;

a fixing cylinder, vertically placed at the mounting hole of the housing and located inside the housing, wherein an opening is formed at a top of the fixing cylinder;

a control circuit board, provided at a bottom of the fixing cylinder, and configured to adjust lighting effect and control a corresponding operation;

a flame sheet assembly, provided at the opening of the top of the fixing cylinder, wherein the flame sheet assembly protrudes from the mounting hole of the housing through the opening of the top of the fixing cylinder;

an elastic supporting assembly, provided inside the fixing cylinder and located at an upper part thereof, wherein the elastic supporting assembly movably extends through the flame-sheet assembly;

a light emitting diode (LED) lamp, provided on the control circuit board and electrically connected to the control circuit board;

a light guiding assembly, provided on the control circuit board and configured to guide light emitted by the LED lamp to the flame sheet assembly to illuminate the flame sheet assembly;

a power source, provided at the opening of the bottom of the housing and electrically connected to the control circuit board;

wherein the elastic supporting assembly comprises: a spring, vertically provided inside the fixing cylinder and located at an upper part thereof; a first supporting rod, vertically provided at a top end of the spring; and a second supporting rod, laterally provided at a top end of the first supporting rod, wherein the second supporting rod movably extends through the flame sheet assembly;

further comprising a mounting pillar vertically provided on an inner surface of the fixing cylinder, the spring being sleeved on the mounting pillar, a bottom end of the spring being attached to a bottom end of the mounting pillar, a first blind hole and a second blind hole being vertically formed on an inner wall of the fixing cylinder, the first blind hole communicating the second blind hole, the first supporting rod being inserted into the first blind hole, and the second supporting rod being inserted into the second blind hole.

2. The electronic candle lamp of claim 1, wherein the flame sheet assembly comprises:

a flame sheet, provided at the opening of the top of the fixing cylinder and placed vertically;

a connecting sheet, provided at a bottom of the flame sheet and placed vertically, wherein a through hole is formed laterally at a connection of the flame sheet and the connecting sheet;

a pendulum, provided at a bottom of the connecting sheet;

a magnet, provided at a bottom of the pendulum; and an electromagnetic coil, facing and spaced apart from the magnet, and provided on the control circuit board and electrically connected to the control circuit board.

3. The electronic candle lamp of claim 1, wherein the spring, the first supporting rod, and the second supporting rod are integrally formed.

4. The electronic candle lamp of claim 1, wherein the spring, the first supporting rod, and the second supporting rod are integrally formed from spring steel.

5. The electronic candle lamp of claim 1, wherein a sunken portion is formed on the second supporting rod, and the flame sheet assembly is located at the sunken portion of the second supporting rod.

6. The electronic candle lamp of claim 1 further comprising a bracket, provided on the control circuit board, wherein the LED lamp and the light guiding assembly are disposed at an upper part of the bracket in a way that they both incline toward the flame sheet, and the light guiding assembly is located between the LED lamp and the flame-like sheet assembly in light emitting direction of the LED lamp.

7. The electronic candle lamp of claim 6, wherein the light guiding assembly is a convex mirror located above the LED lamp, the light emitted by the LED lamp illuminates the flame sheet assembly through the convex mirror.

8. The electronic candle lamp of claim 1, wherein the power source is a battery pack.

9. The electronic candle lamp of claim 1, wherein the fixing cylinder comprises: a base, on which the control circuit board being provided; and a cylinder assembly, a bottom thereof being attached to the base and a top thereof being provided at the mounting hole of the housing, wherein the top and the bottom of the cylinder assembly respectively form openings; wherein the opening of the top of the cylinder assembly communicates the mounting hole of the housing, the flame sheet assembly protrudes from the mounting hole of the housing through the opening of the top of the cylinder assembly.

10. The electronic candle lamp of claim 9, wherein the cylinder assembly comprises: a first cylinder, a top end thereof being provided at the mounting hole of the housing; and a second cylinder, a top end thereof being attached to a bottom end of the first cylinder and a bottom thereof being attached to the base; wherein tops and bottoms of both the first cylinder and the second cylinder form openings, respectively, the opening at the top of the first cylinder communicating the mounting hole of the housing, the opening at the bottom of the first cylinder communicating the opening at the top of the second cylinder, the flame sheet assembly protruding from the mounting hole of the housing through the opening at the top of the first cylinder.

11. The electronic candle lamp of claim 1, wherein the housing comprises a flat plate provided on the top of the housing, wherein the mounting hole is formed on the flat plate.

12. The electronic candle lamp of claim 1, wherein the housing is made of paraffin material or imitating paraffin plastic.

* * * * *